US005783343A

United States Patent [19]

Tombs et al.

[11] Patent Number: 5,783,343

[45] Date of Patent: Jul. 21, 1998

[54] IMAGE FORMING METHOD AND APPARATUS USING PRETRANSFER ERASE

[75] Inventors: Thomas N. Tombs, Brockport; John W. May, Rochester, both of N.Y.

[73] Assignee: Eastman Kodak Company, Rochester, N.Y.

[21] Appl. No.: 343,055

[22] Filed: Nov. 21, 1994

[51] Int. Cl.[6] ..... G03G 13/01; G03G 13/045; G03G 15/01; G03G 15/045

[52] U.S. Cl. ..... 430/47; 430/42; 430/48; 430/126; 399/32; 399/296

[58] Field of Search ..... 430/47, 48, 126, 430/42, 44; 355/214, 273; 399/296, 32

[56] References Cited

U.S. PATENT DOCUMENTS

| | | | |
|---|---|---|---|
| 4,853,736 | 8/1989 | Goto et al. | 355/210 |
| 5,038,177 | 8/1991 | Parker et al. | 355/273 |
| 5,119,140 | 6/1992 | Berkes et al. | 355/273 |
| 5,166,734 | 11/1992 | Pinhas et al. | 355/273 |
| 5,241,356 | 8/1993 | Bray et al. | 355/328 |
| 5,260,752 | 11/1993 | Fuma et al. | 355/273 |
| 5,459,563 | 10/1995 | Fuma et al. | 399/296 |

FOREIGN PATENT DOCUMENTS 61-213875 9/1986 Japan .

OTHER PUBLICATIONS

Patent & Trademark Office English–Language Transaction of JP 61–213875 (Pub Sep. 1986).

*Primary Examiner*—Janis L. Dote
*Attorney, Agent, or Firm*—Norman Rushefsky

[57] ABSTRACT

A toner image having two or more levels of toner density is transferred to a receiving surface more efficiently by erasing voltage associated with the higher density portions of the image member to a different extent than voltage is erased in the lower density portions of the image member.

23 Claims, 1 Drawing Sheet

IMAGE FORMING METHOD AND APPARATUS USING PRETRANSFER ERASE

This invention relates to an image forming method and apparatus in which a toner image is formed on an image member and transferred to a surface of a receiving sheet or another surface such as the surface of an intermediate member.

Toner images formed on an image member using an electrostatic image are held by the electrostatic image to the image member. The electrostatic forces holding the toner to the image member are sometimes reduced prior to transfer to improve the transfer of the toner to another surface. Reduction of the electrostatic holding force between the image member and the toner reduces the amount of force necessary to transfer the toner. At the same time, reduction of charge on the toner itself reduces some of the force available to transfer the toner electrostatically. For example:

U.S. Pat. No. 5,241,356, granted Aug. 31, 1993 to Bray et al, is typical of many disclosures showing use of an erase lamp between development and transfer to remove residual charge in the image member and allow for effective transfer using an electrostatic field created by corona sprayed on the back of a transfer sheet. The erase lamp is positioned behind the image member and the photoreceptive surface is exposed through a support that is transparent to the erase light.

U.S. Pat. No. 5,119,140, granted Jun. 2, 1992 to Berkes et al, and U.S. Pat. No. 5,166,734, granted to Pinhas Nov. 24, 1992, are typical of a number of references which show the use of corona sprayed on the image side of an image member immediately prior to transfer. In the first reference the corona is said to improve the efficiency of low density transfer, while in the second reference it is said to avoid electrical discharge during transfer.

U.S. Pat. No. 4,853,736, granted Aug. 1, 1989 to Goto et al, suggests that radiation from a pretransfer exposure on the front side of an image member should be two or more times that of the light used for image exposure.

U.S. Pat. No. 5,260,752 shows imagewise exposure of a toner image already formed on an image member using discharged area development to improve transfer without causing spreading of the toner image that would occur if the entire image frame were erased. Apparently the erasing exposure is of the same intensity as the image exposure.

SUMMARY OF THE INVENTION

In analyzing the transfer of toner images which have been created by a "gray scale" exposure, we have found that the ideal transfer voltage for transferring toner in the highest density portion of an image is not the same as the voltage that is most efficient for the lower density portions of the image. This is due to the effect that the toner itself has on pre-nip ionization. This phenomenon is illustrated for a charged area development (CAD) process in FIG. 1 in which the transmission density of a transferred toner image is plotted against the transfer bias used for two density levels of an original image on a photoconductor. The curves H and H' represent the high density portion of the image while curves L and L' represent the low density portion of the image. The solid lines H and L represent transfer when the toned photoconductor has been photo-erased (with the same amount of erase light) and the dotted lines H' and L' represent transfer when the image has not been erased. The declines in transfer efficiency at the highest voltages in all four curves are caused by pre-nip ionization which sprays the toner with charges of opposite polarity hindering electrostatic transfer. Note that the presence of more toner in the high density portions of the image allows the application of a higher voltage without pre-nip ionization while the use of the erase increases transfer at a given voltage but also exhibits pre-nip ionization at a lower voltage.

In analyzing this data, we compared an erased image that is transferred either at a voltage corresponding to points B and E or at a voltage corresponding to points A and C. Neither is optimum in both areas. We noticed that no other single voltage is optimum for both high and low density images. However, if the low density areas are not erased, they can be transferred with maximum efficiency at point D which also coincided with the voltage used for transferring the high density portions of the image which had been erased, as shown at point B.

It is an object of the invention to improve the transfer of toner images having more than one level of density in addition to background.

This and other objects are accomplished by a method and apparatus which first forms an electrostatic image on an image member, which electrostatic image has a plurality of potential levels. Charged toner is applied to the electrostatic image to form a toner image defined by the electrostatic image and having at least two different toner densities in addition to any toner-free ("background") areas, a higher density and a lower density. The voltage associated with the image member is selectively erased according to the density of the toner image which, for a CAD process, causes the voltage associated with the higher density portions of the toner image to be reduced by a greater amount than the reduction of voltage associated with the lower density portions of the image. Conversely, for a discharged area development (DAD) process, the lower density portions are erased to a greater extent than the higher density portions. In both CAD and DAD, the erase is a direct function of the voltage of the original electrostatic image. The toner image is then transferred to a receiving surface by bringing the toner image into contact or close proximity with the receiving surface in the presence of an electric field of a direction urging such transfer.

According to a preferred embodiment, the original image is formed on a photoconductive image member by exposure using an electronic device such as a laser or an LED printhead. The erasing step can be accomplished by the same device as that making the original imaging exposure or by a second electronic device. Both devices can be driven from the same electronic image source with an original signal used for imaging and a conversion of that signal to an appropriate erase signal being used for erase. In both CAD and DAD, the erase is varied as an inverse function of the original exposure.

According to further preferred embodiments, the process can be applied to any gray level image regardless of the number of levels, as well as to continuous or analog images without discrete levels. All that is required is that at least two portions of the image have different levels of toner (in addition to any background).

Utilizing the invention transfer in the highlights and shadows of an image having varying densities is optimized.

DETAILED DESCRIPTION OF THE INVENTION

Figure 1:
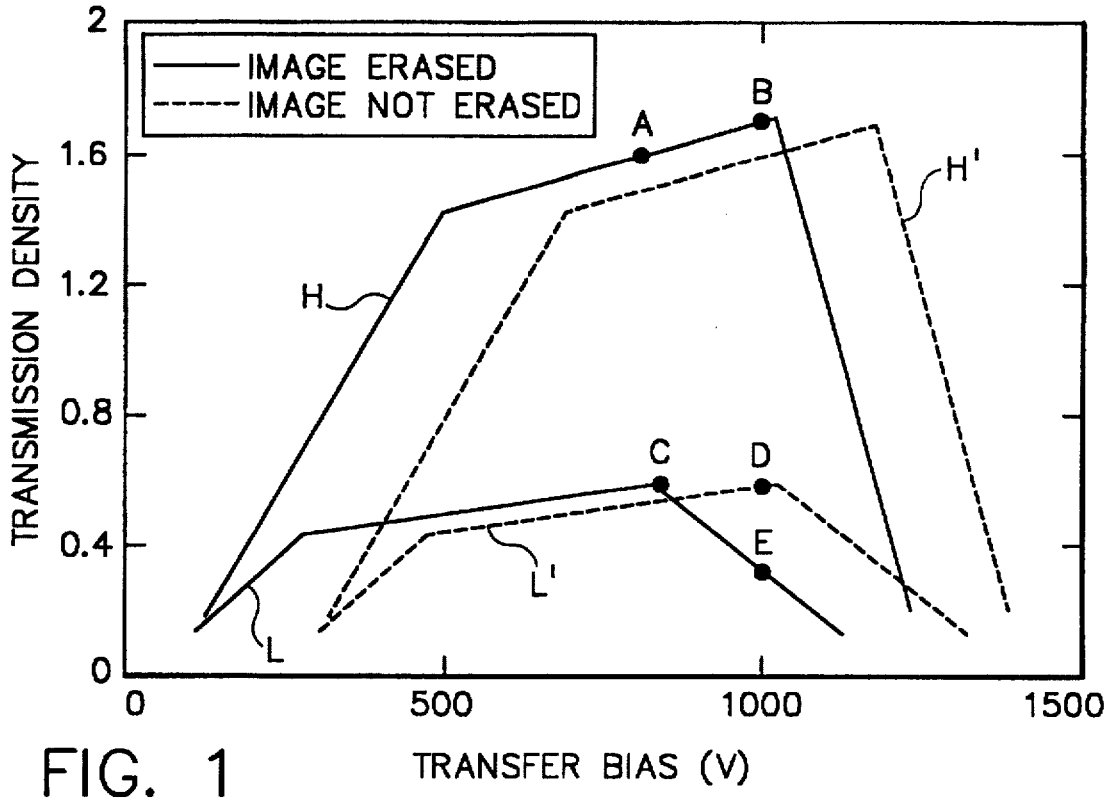
FIG. 1 is a representation of a CAD process in which transmission density is plotted against transfer voltage for two different original toner image density levels that have both been erased and not erased.
Figure 2:
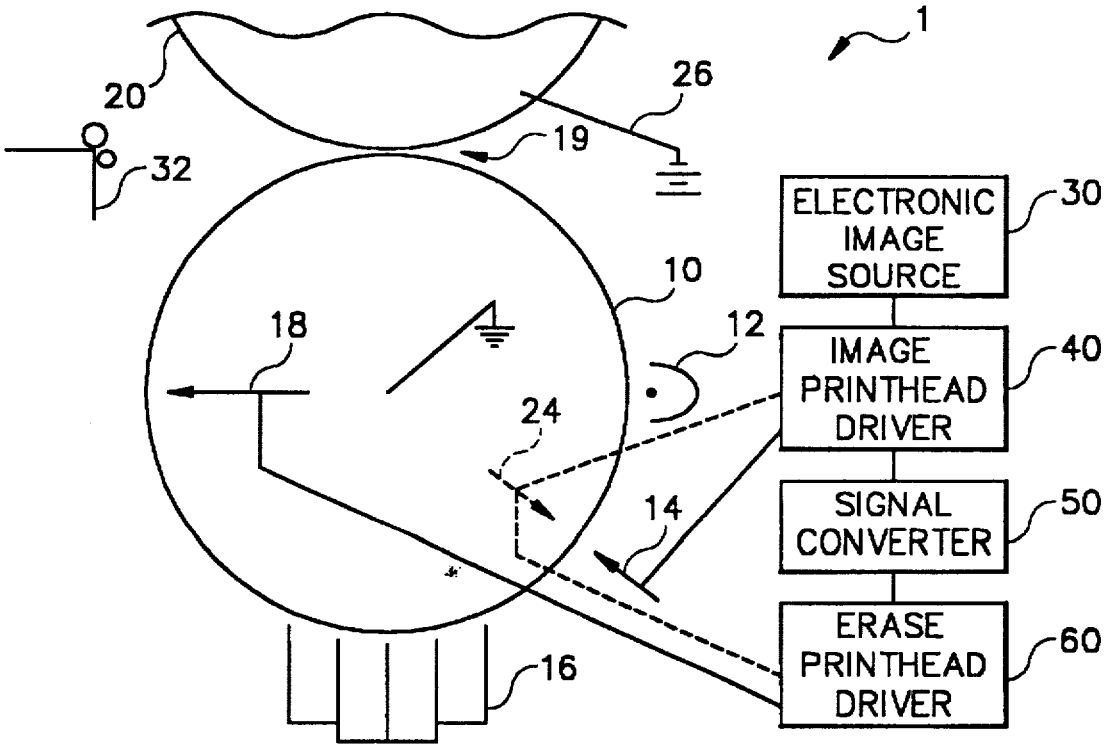
FIG. 2 is a side schematic of an image forming apparatus.

According to FIG. 2, an image forming apparatus 1 is shown to make use of the phenomenon explained above with respect to FIG. 1. An image member 10 is used to form toner images on its outer surface as it rotates in a clockwise direction. Preferably, image member 10 has one or more radiation sensitive layers to enable image formation, for example, image member 10 can be a photoconductive image member. Image member 10 is first charged by a charging station 12 and then exposed by an exposing station, for example, a laser 14 to create an electrostatic image. Toner is applied to the electrostatic image from one of four toning stations contained in a toning module 16 to create a toner image defined by the electrostatic image. The toned image member undergoes an erase procedure by an erase device, for example, a laser 18. The image is transferred to a receiving surface at a transfer station 19. The receiving surface can be the surface of a receiving sheet fed from a receiving sheet supply 32 into transfer station 19. Alternatively, the toner image can be transferred to a surface of an intermediate transfer member 20.

A series of different toner images, for example, toner images of different color, can be formed on the image member (using toning stations 16) and transferred in registration to the transfer surface to form a combined toner image, for example, a multicolor image. Such multicolor images can be formed by transfer to the intermediate member for subsequent transfer in a single step to a receiving sheet (remotely from image member 10 or in the transfer nip shown). Alternatively, the receiving sheet can be attached to transfer member 20 and recirculated through transfer relation with image member 10 to accumulate the images directly on the receiving sheet. These alternatives are generally known in the art and can all be improved by the invention.

Whatever the surface to which the toner is transferred, it is accomplished in the presence of an electric field urging such transfer. Such an electric field can be created by spraying corona on the back of a receiving sheet or by biasing member 20 with a potential source 26. Thus, member 20 can either be an intermediate member to which an image is transferred or a backup roller for creating the field for transfer to a receiving sheet fed into a nip between member 20 and image member 10.

Conventional electronic printers and copiers utilize a laser or LED printhead for exposure that is either on or off during imaging. Details in highlights or shadows are defined by the number of pixels in a particular area that are on. However, improved quality, especially of pictorial imaging, can be obtained by what is called gray scale imaging in which the exposure creates a variety of potential levels in the electrostatic image either by varying its intensity or, in the case of an LED printhead, by varying the time it is on. Adaptations of this approach can provide as few as two levels of gray or so many levels of gray that the tone is considered to vary continuously.

When such a "gray scale" electrostatic image is toned by a CAD or a DAD process, the toner coverage will vary directly or inversely according to the potential in the image. Depending on the field used in the development station, such a toner image will have more than one level of density. As seen from the analysis of FIG. 1, the amount of toner being transferred electrostatically in a CAD process has an effect on the pre-nip ionization, as does the amount of erase used. This is also true for a DAD process. Erase device 18 is designed to selectively erase the toned image member according to the predicted or measured transmission density of each portion of the image.

This is accomplished by adapting the same signal used for driving the original exposing laser 14 to drive an erase laser 18. More specifically, an electronic image source 30, which can be a scanner, a raster image processor of a printer or a suitable memory, provides an electronic signal to be used for imaging. That signal is conventionally fed to an image printhead driver 40 to drive exposing laser 14 to form an electrostatic image having at least three potential levels (assuming some background). The same signal is fed to a signal converter 50 which converts the signal to an erase signal which is fed to an erase printhead driver which, in turn, drives erase laser 18. Signal converter 50 analyzes the input image signal from electronic image source 30 and provides an intensity signal for laser 18 for each portion of the image. Signal converter 50 can have many forms. A small number of levels can be handled by an ordinary lookup table. For a large number of levels or a continuously varying density, an empirically derived formula is preferred. Information from sensors, e.g., transmission density of a test area, can be used to adjust the lookup table or modify the empirically derived formula. The data on which the operation signal converter 50 is based is derived from experimental transfer data. In the most simple CAD case illustrated in FIG. 1, zero erase is given each portion of the image having low density, for example, less than 0.8, and a full erase intensity is given to each portion of the image having a density above 0.8. Transfer is then accomplished at just under 1,000 volts. With more levels or a continuous tone image, an erase which gradually increases according to toner image density is applied as controlled by signal converter 50. Conversely, for a DAD process, the erase gradually decreases as toner image density increases. In either case, the erase is increased as the voltage of the electrostatic image defining the toner image increases. With most medium contrast materials, the amount of erase light increases substantially linearly as toner coverage increases (in CAD processes) for most of the exposure scale, with a nonlinear tendency toward greater increases at highest toner coverage. However, whatever the relationship for the materials used, an empirically designed lookup table can provide accurate results. Background (areas intended to have no toner) is preferably not erased in CAD or DAD systems so that any toner inadvertently adhering to such areas will not be further encouraged to transfer because of the erase.

Erasing device 18 can be any electronic exposure device including a laser or an LED printhead. It should be well registered with the exposure laser 14 for best results. According to another embodiment, a separate erase device 18 can be eliminated and erasing accomplished by the imaging exposure device 14 utilizing a second revolution of image member 14. For this purpose, it may be preferable to have the combination imaging and erasing printhead located on the reverse side of the image member 10, as shown in phantom at 24.

Placing printhead 18 or 24 inside image member 10 prevents the toner itself from interfering with the discharge to be accomplished by the erasing step. If the printhead 18 or 24 is positioned inside image member 10 the image member has at least one photoconductive layer on an image side of a transparent support and the electronic erasing printhead is positioned to expose the photoconductive layer through the transparent support. If an erase light to which the toner is at least partially transparent is used, the erase light (whether from printhead 18 or printhead 24) can be on the image side of image member 10.

This invention is effective with any electrostatic transfer, whether done with a roller backing a receiving sheet, a corona sprayed on the back of a receiving sheet or with transfer to an intermediate member such as member 20, shown in FIG. 2.

Note that the invention can be used to get the highest possible efficiency at each level of transmission density. Alternatively, the invention can be used to provide excellent transfer efficiency but with more safety from pre-nip ionization by reducing the transfer voltage slightly from the highest possible level.

It will be recognized by those skilled in the art that the original electronic image can be in either analog or digital form since a suitable conversion from an image signal to an erase signal can readily be made with either.

The prior art shows the utilization of corona as well as radiation for pretransfer erase. Imagewise coronas are known, for example, using a separately addressable array of corona sources, such as an array of separately addressable grids. Such a device could be used to practice this invention by positioning an imaging corona device on the image side of image member 10 and applying an appropriate erase signal to it. Because of the sophistication, accuracy and relatively low cost of lasers and LED printheads, they are preferred.

This invention is particularly suitable for transferring high resolution color images, both because higher image quality is desired and also because transfer latitude decreases greatly when transferring to a surface already containing several layers of toner.

The invention has been described in detail with particular reference to a preferred embodiment thereof, but it will be understood that variations and modifications can be effected within the spirit and scope of the invention as described hereinabove and as defined in the appended claims.

We claim:

1. A method of forming toner images comprising:

forming an electrostatic image having a plurality of potential levels on a first side of a photoconductive image member, applying charged toner to the electrostatic image to deposit toner of a single color in densities that are a function of said potential levels to form a toner image defined by the electrostatic image and having at least two portions of the toner image containing toner of said single color which have different densities, a higher density and a lower density of the toner image, applying erasing radiation to the toner image while electronically imagewise varying the amount of erasing radiation according to the density of the toner image, and transferring the toner image as a single color toner image to a receiving surface in the presence of an electric field of a direction urging such transfer.

2. The method according to claim 1 wherein the step of forming an electrostatic image includes charging the photoconductive image member and imagewise exposing the photoconductive image member.

3. The method according to claim 2 wherein the step of imagewise exposing includes applying an electronic image signal to an electronic exposure means to expose the image member according to the electronic image signal and wherein the step of applying erasing radiation includes applying an electronic erase signal to an electronic erase means for erasing the voltage associated with the toner image member in accordance with the electronic erase signal and deriving the electronic image signal and the electronic erase signal from a single original image signal.

4. The method according to claim 1 wherein the photoconductive image member has a support that is transparent to the erasing irradiation and wherein the step of applying erasing radiation includes exposing the toner image with erasing radiation from the transparent support side of the image member.

5. The method according to claim 1 wherein the transferring step includes the step of transferring the toner image to an intermediate image member.

6. The method according to claim 5 further including repeating all the steps defined in claim 5 to form a series of toner images on the image member wherein the step of transferring includes transferring the toner images in registration to the receiving surface of the intermediate image member.

7. The method of claim 6 wherein the series of toner images is a series of single color images of different colors that when transferred to the intermediate image member form a plural color image on the intermediate image member.

8. The method of claim 1 wherein in transferring the toner image to a receiving surface the toner image is brought into contact with the receiving surface.

9. The method of claim 1 wherein in the step of forming an electrostatic image grayscale imaging exposure is provided to create at least three potential levels in the electrostatic image.

10. The method of claim 9 wherein in the step of applying erasing radiation amounts of erasing radiation are greater for portions of the electrostatic image having higher potential levels.

11. The method of claim 10 wherein the amount of erasing radiation increases as toner density increases.

12. The method of claim 10 wherein the amount of erasing radiation decreases as toner density increases.

13. A method of forming toner images comprising:

forming an electrostatic image on a photoconductive image member, said electrostatic image having charged areas with a plurality of potential levels, applying a single color of toner to the charged areas of the electrostatic image to deposit said toner in a plurality of densities that are a direct function of the plurality of potential levels, to form a toner image defined by the electrostatic image, said toner image having a density which includes a higher density and a lower density, selectively erasing voltage associated with the toner image according to the density of the toner image by erasing the voltage associated with the higher density of the toner image to a greater extent than the voltage associated with the lower density of the toner image, and transferring the toner image to a receiving surface in the presence of an electric field of a direction urging such transfer.

14. The method according to claim 13 wherein the step of forming an electrostatic image includes the substeps of uniformly charging the photoconductive image member and imagewise exposing the photoconductive image member.

15. A method of forming toner images comprising:

forming an electrostatic image on a photoconductive image member, said electrostatic image having discharged areas with a plurality of potential levels, applying a single color toner to the electrostatic image to deposit toner in a plurality of densities that are an inverse function of the plurality of potential levels, to form a toner image defined by the electrostatic image, said toner image having a varying density in said single color including a higher density and a lower density, selectively erasing voltage associated with the toner image according to the density of the toner image, by erasing the voltage associated with said lower density of the toner image to a greater extent than the voltage associated with said higher density of the toner image, and transferring the toner image as a single color toner image to a receiving surface in the presence of an electric field of a direction urging such transfer.

16. A method of forming toner images comprising:

uniformly charging a photoconductive image member, imagewise exposing to radiation the photoconductive image member with an exposure having a plurality of exposure levels including higher and lower exposure levels to create an electrostatic image having at least three voltage levels, applying a single color toner to the electrostatic image to form a toner image defined by the electrostatic image and having a toner density which varies according to said voltage levels and including toned portions in said single color toner of higher density and of lower density, selectively erasing voltage associated with the image member according to the imagewise exposing step by applying erasing radiation to the toned portions of higher density and of lower density with a lesser amount of erasing radiation being provided to a toned portion of higher density than an amount of erasing radiation provided to a toned portion of lower density, and transferring the toner image as a single color toner image to a receiving surface in the presence of an electric field of a direction urging such transfer.

17. A method of preparing a single color toner image carried by a photoconductive image member for transfer, which toner image has toned areas of more than one density of toner of a single color, said method comprising applying erasing radiation to the toner image and electronically imagewise varying amounts of the erasing radiation at toned areas of a single color according to the density of the toned areas of the toner image wherein some toned areas obtain greater amounts of erasing radiation and other toned areas obtain erasing radiation of lesser amounts, and providing an electric field of a direction urging transfer of the toner image as a single color toner image to a receiving surface.

18. A method of transferring a single color toner image carried by a photoconductive image member to an intermediate image member, which toner image includes toned areas of a single color at both higher and lower densities, said method comprising:

applying erasing radiation to the toned areas of higher and lower densities while electronically imagewise varying amounts of the radiation according to the density of the single color toner in the toned areas, and transferring the toner image as a single color image to said intermediate image member by applying an electrical field to the image of a direction urging such transfer.

19. An image forming apparatus for forming a toner image on a receiving surface, said apparatus comprising:

a photoconductive image member having a charge retentive surface, means for forming an electrostatic image on the charge retentive surface of the photoconductive image member, which electrostatic image has at least three potential levels, means for applying a single color charged toner to the electrostatic image to deposit toner in a plurality of densities that are a function of the potential levels, to form a toner image defined by the electrostatic image, said toner image having some toned areas of said single color toned in a higher density and some toned areas of said single color toned in a lower density, means for imagewise applying erasing radiation to the toned areas of the toner image in respective amounts directly or inversely proportional to density of said toned areas, and means for transferring the toner image as a single color toner image to a receiving surface in the presence of an electric field of a direction urging such transfer.

20. The apparatus according to claim 19 wherein said means for forming an electrostatic image includes means for applying a uniform charge to the charge retentive surface and an electronic exposure device for imagewise exposing the charged image member to create an electrostatic image and means for controlling the electronic exposure device according to an electronic image signal.

21. The apparatus according to claim 20 wherein said means for erasing is an electronic erasing means for converting an electronic erase signal into erasing radiation and a signal converter for creating an electronic erase signal proportional to the electronic image signal.

22. The apparatus according to claim 21 wherein the electronic exposure device and the electronic erasing means include the same electronically controlled source of radiation.

23. The apparatus according to claim 21 wherein said image member has at least one photoconductive layer and a transparent support upon which the photoconductive layer is supported and wherein the electronic erasing means is positioned on the transparent support side of the image member.

* * * * *